US008840041B2

(12) United States Patent
Martinez

(10) Patent No.: US 8,840,041 B2
(45) Date of Patent: Sep. 23, 2014

(54) SHOWER HEAD HAVING AN ELECTRIC TANKLESS WATER HEATER

(75) Inventor: Marta Martinez, Hialeah, FL (US)

(73) Assignee: Drakken Industries, LLC, Hialeah, FL (US)

( * ) Notice: Subject to any disclaimer, the term of this patent is extended or adjusted under 35 U.S.C. 154(b) by 356 days.

(21) Appl. No.: 13/272,190

(22) Filed: Oct. 12, 2011

(65) Prior Publication Data

US 2012/0145807 A1 Jun. 14, 2012

Related U.S. Application Data

(60) Provisional application No. 61/392,184, filed on Oct. 12, 2010.

(51) Int. Cl.

| | |
|---|---|
| ***B05B 1/24*** | (2006.01) |
| ***F24D 17/00*** | (2006.01) |
| ***E03C 1/044*** | (2006.01) |

(52) U.S. Cl.

CPC ..... *E03C 1/044* (2013.01); *F24D 17/0026* (2013.01); *F24D 17/0089* (2013.01)

USPC ..... 239/135; 239/75; 239/132; 239/139; 239/289; 239/525; 239/530; 392/465; 392/474; 392/485; 4/598; 237/19

(58) Field of Classification Search

USPC ..... 239/13, 75, 132, 135, 139, 289, 525, 239/530, 589; 392/465, 473, 474, 485, 490, 392/494; 4/598, 605, 615; 237/19

See application file for complete search history.

(56) References Cited

U.S. PATENT DOCUMENTS

| | | | | |
|---|---|---|---|---|
| 2,044,634 A * | 6/1936 | Rieder | ..... | 392/473 |
| 2,588,314 A * | 3/1952 | Wicks | ..... | 392/485 |
| 2,861,170 A * | 11/1958 | Latorre Rodriguez | ..... | 392/474 |
| 4,085,308 A * | 4/1978 | Youngquist | ..... | 392/473 |

* cited by examiner

*Primary Examiner* — Steven J Ganey

(74) *Attorney, Agent, or Firm* — Daniel S. Polley, P.A.

(57) ABSTRACT

A combined showerhead and tankless water heater. A control panel permits a user to adjust the temperature level of the water that is heated. In one embodiment, the water flowing through the tankless water heater portion can be heated up about an additional eighteen (18) degrees.

21 Claims, 7 Drawing Sheets

SHOWER HEAD HAVING AN ELECTRIC TANKLESS WATER HEATER

This application claims the benefit of and priority to U.S. Provisional Patent Application Ser. No. 61/392,184, filed Oct. 12, 2010, which is incorporated by reference in its entirety.

FIELD OF THE INVENTION

The invention relates generally to tankless water heaters and more particularly to a combined tankless water heater and shower head.

SUMMARY OF THE INVENTION

The present invention provides a novel combined shower head and tankless water heater for use in with a shower to provide hot water for as long as the user desires. With the use of the present invention, water is heated only at the specific shower location and only when needed, to aid with energy and water conservation. Multiple power settings can preferably be provided to the user. Based on the power setting selected by the user, the user is provided with virtually instant warm water from the shower head for as long as they want. Preferably, the present invention works with 110/120/220 Volts power source with an amperage of about 23, about 25 or about 30 amps, though such values are not considered limiting. Furthermore, other power sources can be used and include other electrical, battery, solar, etc. power sources. These power sources are also considered within the scope of the invention. The housing enclosing the tankless water heater circuitry and components can be constructed from high strength ABS Plastic, though such is not considered limiting and other materials can be selected and are considered within the scope of the invention. The heat exchanger component of the present invention can be constructed from stainless steel and the heating elements constructed from brass and copper, though such materials/metals are not considered limiting and other materials/metals can be selected and are considered within the scope of the invention. In one non-limiting embodiment, the dimensions can be about 10.5"×about 4.7"× about 4.3", though other dimensions can be used and are considered within the scope of the invention.

The heat exchanger is preferably sealed and can be monitored by auto-resettable circuit breakers. A flow switch can be provided for detecting the flow of water. When water flows in, a relatively small spring loaded "bullet switch" can be provided to active the unit which informs the onboard microprocessor to heat the elements in the heat exchanger.

Preferably, the present invention is a 2.5 k or 3 kW unit that can plug into a standard, grounded electrical socket. The present invention relatively quickly converts a cold water shower into a warm water shower, and in one non-limiting embodiment, warms or heats the water about an extra eighteen (18) degrees Fahrenheit.

The showerhead portion can be configured for a spray volume of about 1 gallon per minute, or can be converted to about 1.5 gallons per minute through removal of a plastic disk at the shower head attachment area. Other spray volumes are possible and are also considered within the scope of the invention.

The control panel or control area, preferably located on a bottom portion of the water heater housing can be provided with a on/off controls, and increase and decrease controls, such that the user is provided with several heating choices to set the water temperature to the temperature or close to the temperature desired by the user. In one non-limiting embodiment, five (5) different heating levels are provided and display can be provided at the control panel so that the user can visually determine which heating level the unit is currently set at.

The present invention self contained showering system preferably screws onto the existing shower pipe where a traditional shower head normally attaches. With the system preferably plugged into an electrical outlet, the system is turned on using the off/on control and the temperature is set use the high/low (increase/decrease) controls.

Certain non-limiting use examples for the present invention showering system include single family homes, homes, apartments, condominiums, motels, hotels, pool showers, motor homes, trailers, boats, fitness clubs, cabins, etc.

DETAILED DESCRIPTION OF THE INVENTION

Figure 1A:
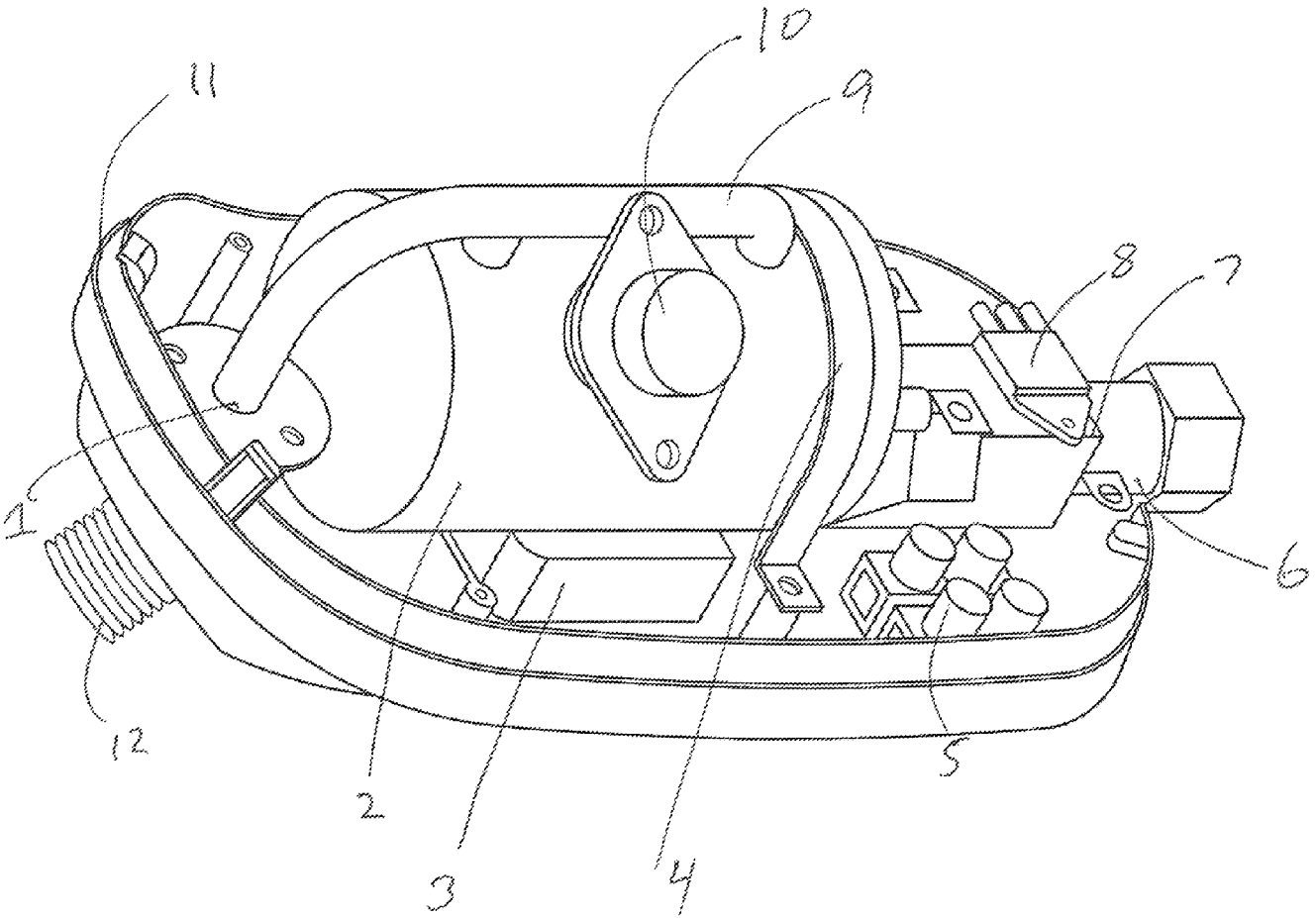
FIG. 1A illustrates a perspective view of the present invention shower head incorporating an electric tankless water heater in accordance with the present invention and with a portion of its housing removed to provide visual access to the electric tankless water heater portion of the present invention.

As seen in the drawings, the present invention can be a relatively small electric tankless water heater reduced to be able to be placed on a shower nipple which comes out of an existing shower ("Water Inlet"). The present invention small compact tankless water heater can be preferably enclosed within a waterproof plastic housing. The interior construction can be preferably comprised of an insulated stainless steel enclosure to which the electric heating element is preferably welded or otherwise secured and can be enclosed away from any exterior components of the present invention.

The present invention water heater can also be provided with a circuit board, such as, but not limited to a Laminate Silicone Circuit board, which in combination with several other components, controls the behavior or operation of the heater. The heater can also be provided with a power cord, such as, but not limited to, a 6 ft, water proof cord which can be attached to the electrical poles in order to power the heating elements. Other power sources for the invention can also be used and are considered within the scope of the invention, such as, but not limited to, one or more batteries, solar power, etc.

The present invention water heater can also be equipped with a ½" swivel female nut which makes it very easy to install on any ½" nipple or hose, for exterior use. Additionally, the present invention water heater can also be provided with a relatively small magnet at the entry way enclosed by a ⅜ male nut and a spring at the very top of the magnet. The magnet can be used as a flow switch, which will allow the unit to engage once it senses water.

In use or operation, the present invention shower head heater can be preferably installed where a conventional current shower head is typically installed and in place of such conventional shower head. The present invention heater easily can be screwed on or otherwise secured, preferably with a nipple having a ½" Female thread (though such is not considered limiting). When an electric cord is used as the power source, it can be connected through the wall, away from the standing or sitting area in the shower, to a preferably 110V outlet with a protective GFI to help prevent any chance of electrocution. Other Voltages and outlets can also be used and are considered within the scope of the invention.

As the consumer turns on the water in the shower, water passes through the inlet side of the heater and preferably pushes the magnet flow sensor up against its furthest point in the inlet chamber. A REED switch (i.e. 2 fine galvanized steel parts, etc.) can be preferably provided underneath the inlet pipe. When the magnet positions itself just above surface of the REED switch, the two contacts of the REED switch close, which allows for the current to flow through the circuit and energize the heating element. As the water travels from the inlet pipe through the opening of the extended enclosure where the heating element is positioned, the water then picks up the heat from the energized heating element. The heated water then travels through the chambers of the shower head and through its small orifices allows for the water to be restricted in order to increase the output temperature.

The present invention water heater can also preferably have 4 or 5 different power setting (though not limiting and other number of settings can be used and are considered within the scope of the invention) which can be easily changed with the press of a button on the inferior or belly portion of the shower head heater. Additionally, a power button can also be provided which cuts off completely the power to the heater. Control of the power setting (i.e. how hot the water should be) can occur by pressing the arrow up, for more power or arrow down for less power. Pressing the arrow controls an internally disposed potentiometer, such as, but not limited to a digital potentiometer, which can be preferably placed on the circuit board.

The present invention heater can also monitor the surface temperature of the enclosed preferred stainless steel housing to make sure the operating temperature stays below a preferred maximum temperature, which can be about 140° F., though such is not considered limiting and other maximum temperatures can be used and are considered within the scope of the invention. With respect to the small magnet (i.e. flow sensor), when the hot water or water demand is at zero, the above noted spring will push back the magnet causing the current to stop, which in turns discontinues power to the heater. A safety thermostat can be provided to cut off power where the temperature exceeds a set threshold (i.e. 140° F., etc.) and can also be designed to detect other hazards and potential hazards.

The present invention provides a total solution for point of use hot water at the shower, with isolation of dangerous electrical parts from the consumer. The present invention shower head can isolate all of the electricity and associated components, and any electrical connection to the consumer. The present invention can preferably use water proof wire type W, and can enclose the heating element in an insulated welded, stainless steel heat exchanger. The present invention can use a flow sensor preferably located just inside the inlet pipe, such that when water passes through the first chamber it pushes the flow sensor against the spring, and a reed switch, closes to create contact, and allows for the circuit to pass through and allow for the Integrated circuit to perform its job of identifying the incoming temp with the outlet temp to draw exact power needed for the demand. The present invention can also use several different safety devices not currently found in the mark, such as, but not limited to, thermostats to disengage the electricity if overheat occurs which will shut down all power to the components. The present invention can also have a 4 power setting that can reduce or increase the power setting depending on the outlet temperature the consumer is looking for. Additionally, the present invention's power connection is preferably not made outside of the unit but rather in a safer environment of a watertight concealed enclosure. The present invention are preferably connected outside the shower through a wall and around to a safe junction box outside the shower, so as to keep the consumer safe from injury. The present invention is preferably constructed such that it is compliant to UL/499, though such is not considered limiting.

The present invention shower head can having the following components, though such is not considered limiting: (a) Heater Element; (b) Water inlet nut; (c) Water inlet fitting; (d) Reed switch; (e) Cooling Plate; (f) Cooling Plate Fitting; (g) TRIAC; (h) Supply Cord Fitting; (i) Heat Exchanger; (j) Thermostat; (k) Terminal; (l) Under Casing enclosure; (m) Upper Casing enclosure; (n) Circuit board; (o) Power setting button; (p) Shower Head upper casing; (q) Shower head lower casing; (r) Shower head connector; (s) Plastic Plate; (t) Spring; and (u) Magnet flow sensor.

Figure 1B:
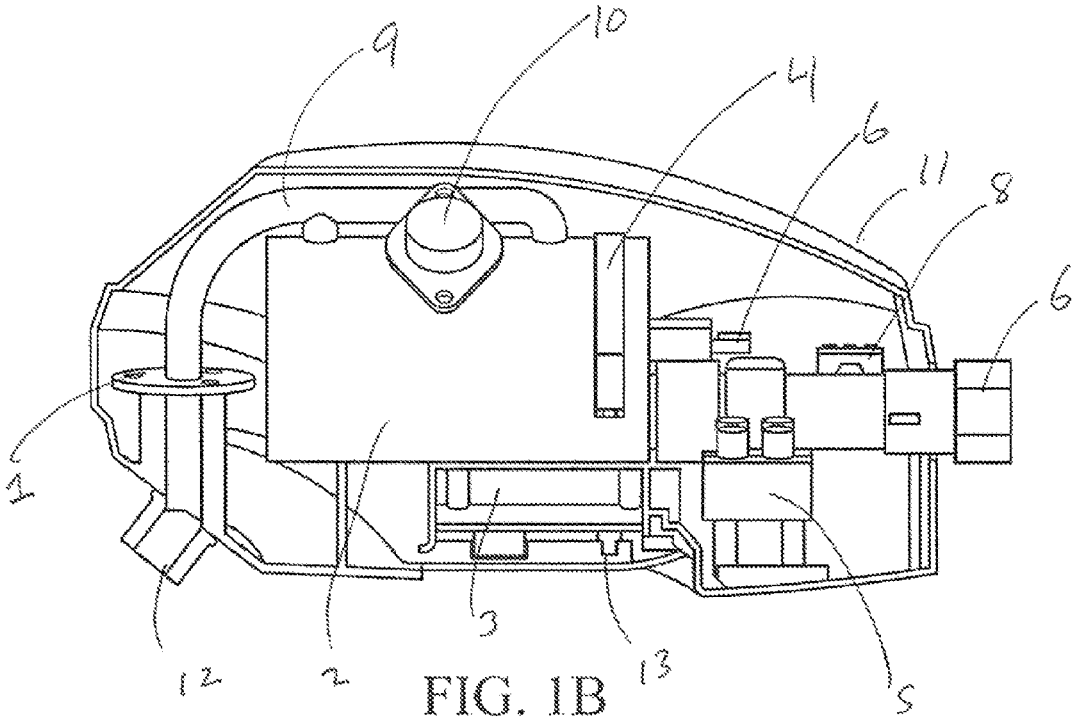
FIG. 1B illustrates a side view of the invention shown in FIG. 1A.
Figure 1C:
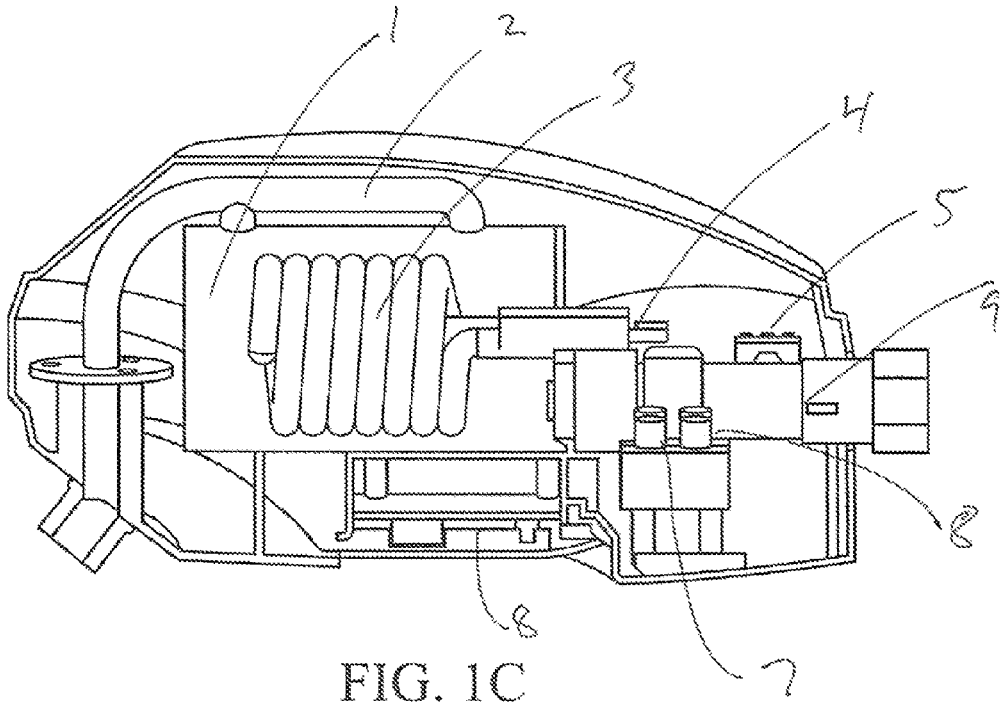
FIG. 1C illustrates another side view of the invention shown in FIG. 1A again with a portion of the housing removed to show the internal components of the present invention.
Figure 2:
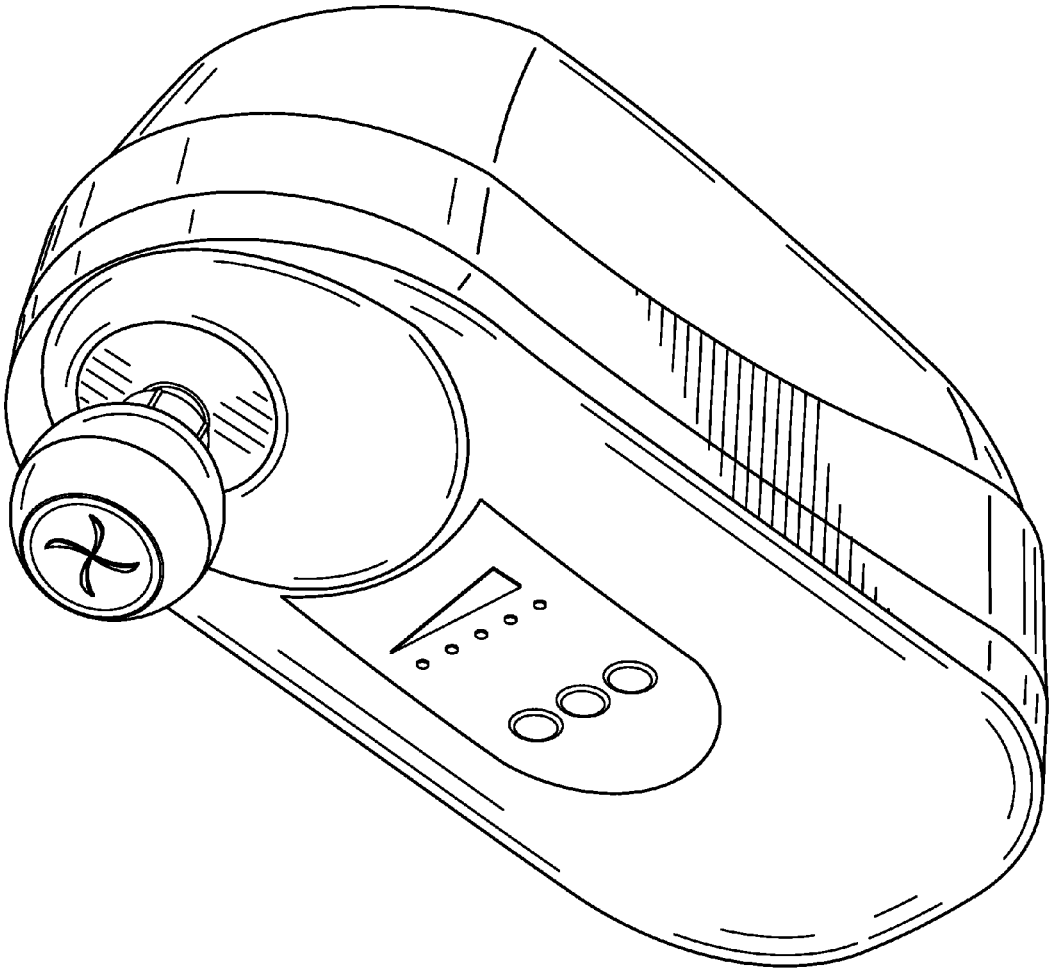
FIG. 2 is a perspective view of a preferred embodiment and preferred housing design and shape for the present invention shower head.
Figure 3:
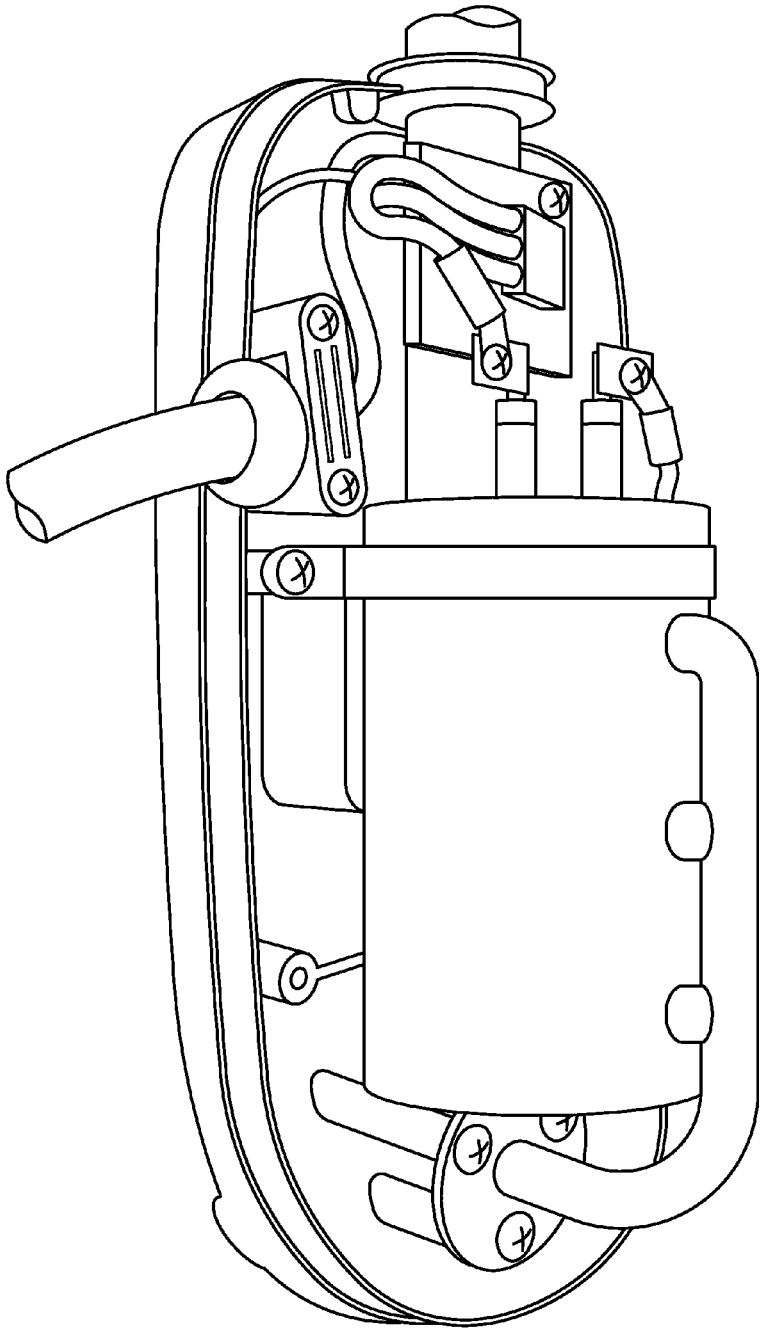
FIG. 3 is another perspective view of the internal components of the present invention shower head.
Figure 4:
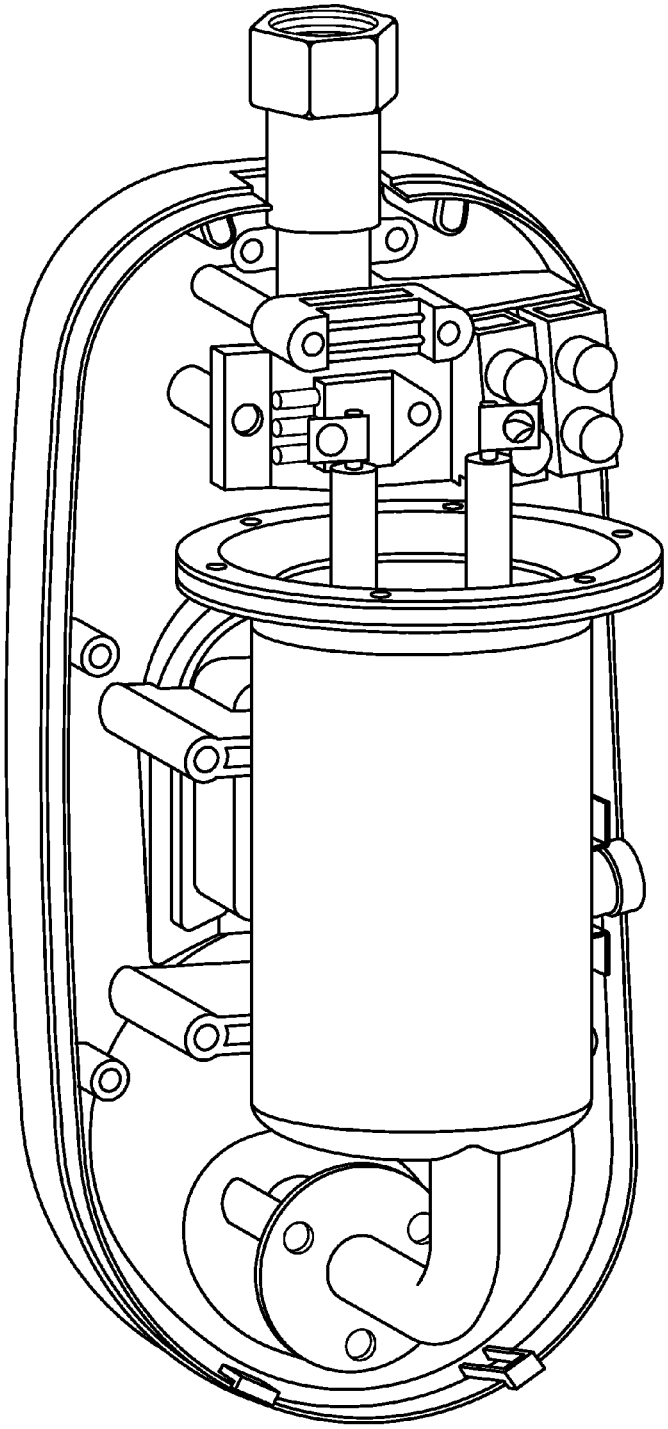
FIG. 4 is another perspective view of the present invention shower heard illustrating the internal components of the shower head.
Figure 5:
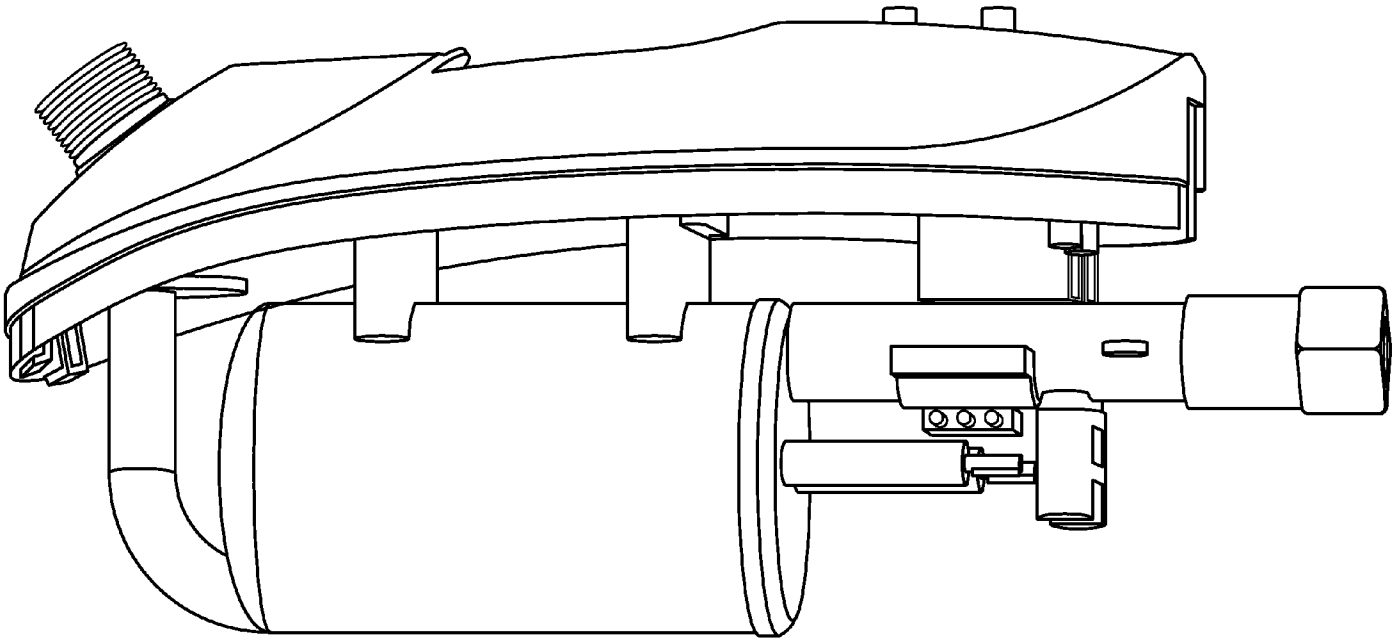
FIG. 5 is a side view of the present invention again illustrating the internal components of the shower head.

FIGS. 1A and 1B illustrate a heat exchange fastener 1, heat exchange 2, circuit board 3, heat exchanger security bracket 4, terminal block 5, heating element electric terminals 6, TRIAC cooling plate 7, TRIACS 8, air diverter 9, safety thermostat 10, shower lower enclosure 11, male adaptor for shower head 12 and laminate control panel 13. FIG. 1C illustrates an insulated heat exchanger 1, air vent diverter 2, heating element 3, heating element terminals 4, TRIAC 5, TRIAC cooling plate 6, terminal block 7, laminate circuit control board 8, and ground busbar 9.

Figure 6:
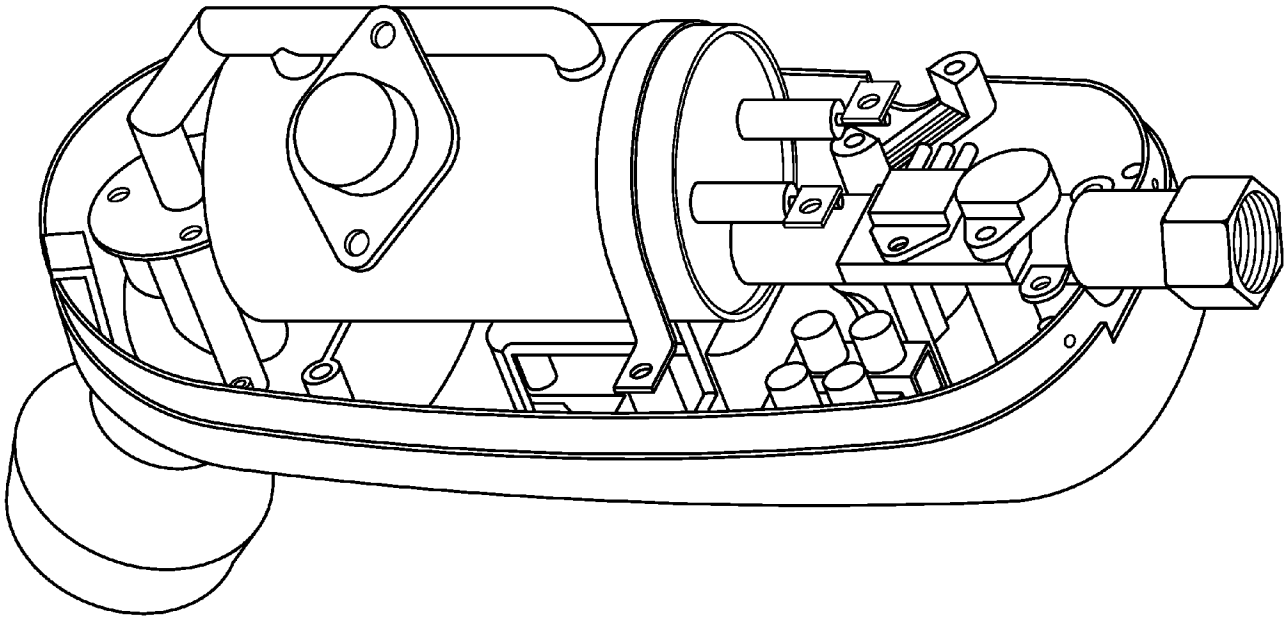
FIG. 6 is another perspective view of the internal components of the present invention shower head.

The system can be provided with a dry fire/air eliminator (air diverter 9—FIG. 1A and 1B air diverter 2—FIG. 1C; see also FIG. 6), which can comprise a pipe that can be designed to eliminate or at least substantially reduce the chance of air or air bubbles in the incoming water pipe from entering the chamber and dry firing the heating element due to air being in contact with the resistance portion of the heating element. The diverter pipe is preferably positioned at the top of the chamber since air rises. Thus, when air or air bubbles comes into the chamber they automatically rise and ultimately enter through the upper pipe track of the air diverter 2 which is in communication with the chamber. By entering air diverter 2, the air or air bubbles are directed away from the heating resistance and out of the heat chamber. Another pipe in communication with the internal area of the chamber is also in communication with the air diverter pipe. The warmed or heated water exits the chamber through this pipe and the heated water meet up with the diverted air and air bubble and continue together through the exit path leading to the sprayer portion of the present invention and thus any content (air, air bubbles, etc.) entering into diverter pipe 2 ultimately get fed back or released into the water flow path, after avoiding the heating resistance where the contents and heated water is permitted to exit out of the sprayer portion.

As a general summary of the internal heating operation, described in more detail above, water passage is provided from the entrance of the supply side through the opening of the present invention. Water then passes through a preferred turbine flow sensor which can be programmed to energize the element at about 0.25 gallons per minute, so that the present invention unit can operate with the lowest of water pressures. Programming is achieved through the onboard microcontroller unit preferably located just above the turbine flow sensor (see FIG. 6), which reads the turbine flow sensor data and sends it to the microprocessor unit. The microprocessor unit can be preferably programmed to energize the heating resistance in accordance to the power setting selected by the user through the control panel.

The safety thermostat can be provided to cut power if there is a surcharge, short circuit, or other type of hazard or potential hazard detected. The heat exchanger enclosure/chamber can be sealed for extra safety and the top and bottom housing enclosure can also form a sealed relationship to prevent water from the shower from entering into the housing.

Unless specifically indicated not to be available or capable, various parts or components or features of one embodiment of the present invention are also considered to be able to provided with other described embodiments of the present invention.

All locations, sizes, measurements, temperatures, amounts, weights, shapes, dimensions, degrees, values, percentages, materials, orientations, etc. discussed above or shown in the drawing figures are merely by way of example and are not considered limiting and other locations, sizes, measurements, temperatures, amounts, weights, dimensions, degrees, values, percentages, materials, orientations etc. can be chosen and used and all are considered within the scope of the invention.

Additionally, the shape of the housing is not considered critical and other housing shapes could be used to house the various internal components.

Unless feature(s), part(s), component(s), characteristic(s) or function(s) described in the specification or shown in the drawings for a claim element, claim step or claim term specifically appear in the claim with the claim element, claim step or claim term, then the inventor does not consider such feature(s), part(s), component(s), characteristic(s) or function(s) to be included for the claim element, claim step or claim term in the claim when and if the claim element, claim step or claim term is interpreted or construed. Similarly, with respect to any "means for" elements in the claims, the inventor considers such language to require only the minimal amount of features, components, steps, or parts from the specification to achieve the function of the "means for" language and not all of the features, components, steps or parts describe in the specification that are related to the function of the "means for" language.

While the invention has been described and disclosed in certain terms and has disclosed certain embodiments or modifications, persons skilled in the art who have acquainted themselves with the invention, will appreciate that it is not necessarily limited by such terms, nor to the specific embodiments and modification disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A tankless water heater adapted for securement to a showerhead sprayer portion, comprising:

a housing having a front end and a back end;

an enclosure contained within the housing;

a heating element disposed within an internal area of the enclosure;

a water inlet path leading, into and in fluid communication with the internal area of the enclosure;

a water outlet path leading out of and in fluid communication with the internal area of the enclosure and adapted for fluid communication with a showerhead sprayer portion;

an onboard circuit board contained within said housing, said circuit board including a microprocessor which determines how much power to supply to said heating element when fluid is flowing within the housing; and a power source to energize said heating element when determined by said microprocessor.

2. The tankless water heater of claim 1 further comprising a flow sensor in communication with said water inlet path, said flow sensor determining when water is entering into the internal area of said enclosure.

3. The tankless water heater of claim 1 wherein said power source is an electric cord which extends out of said housing.

4. The combined showerhead and tankless water heater of claim 1 wherein a first end of said water outlet path is secured at the top of said enclosure near or adjacent to an outlet end or portion of said enclosure.

5. The tankless water heater of claim 1 further comprising a first connector secured to said housing and in fluid communication with said water outlet path, said first connector adapted for connection to a showerhead sprayer portion and a second connector in fluid communication with said water inlet path, said second connector adapted for connection to a water source pipe.

6. The tankless water heater of claim 5 wherein said first connector is a male adaptor.

7. The tankless water heater of claim 5 wherein said second connector is a nut secured to an external end of said water inlet path extending, out of said housing and adapted for receipt and securement to an end of the water source pipe.

8. A combined showerhead and tankless water heater, comprising:

a housing having a front end and a back end;

an enclosure contained within the housing;

a heating element disposed within an internal area of the enclosure;

a water inlet, path leading into and in fluid communication with the internal area of the enclosure;

a water outlet path leading out of and in fluid communication with the internal area of the enclosure;

a first connector secured to said housing and in fluid communication with said water outlet path, said first connector adapted for connection to a showerhead sprayer portion;

a second connector in fluid communication with said water inlet path, said second connector adapted for connection to a water source pipe;

a power source to energize said heating element when it is desired to warm water flowing through the enclosure; and a diverter pipe secured at a top portion of said enclosure and in fluid communication with said enclosure at a first end and in fluid communication with said water outlet path at a second end.

9. The combined showerhead and tankless water heater of claim 8 wherein said first end of said diverter pipe is disposed at the top of said enclosure near or adjacent to an inlet end or portion of said enclosure.

10. A combined showerhead and tankless water heater, comprising:

a housing having a front end and a back end;

an enclosure contained within the housing;

a heating element disposed within an internal area of the enclosure;

a water inlet path leading into and in fluid communication with the internal area of the enclosure;

a water outlet path leading out of and in fluid communication with the internal area of the enclosure;

a first connector secured to said housing and in fluid communication with said water outlet path, said first connector adapted for connection to a showerhead sprayer portion;

a second connector in fluid communication with said water inlet path, said second connector adapted for connection to a water source pipe;

a power source to energize said heating element when it is desired to warm water flowing through the enclosure, a flow sensor in communication with said water inlet path, said flow sensor determining when water is entering into the internal area of said enclosure; and an onboard circuit board contained within said housing and in communication with said flow sensor, said circuit board including a microprocessor which receives information from said flow sensor and determines how much power to supply to said heating element.

11. The combined showerhead and tankless water heater of claim 10 further comprising a control panel in communication with said onboard circuit board, wherein said control panel allowing a user to increase or decrease the amount of power that is supplied to said heating element.

12. The combined showerhead and tankless water heater of claim 10 wherein said control panel is located on a bottom portion of said housing.

13. A combined showerhead and tankless water heater, comprising:

a housing having a front end and a back end;

an enclosure contained within the housing;

a heating, element disposed within an internal area of the enclosure;

a water inlet path leading into and in fluid communication with the internal area of the enclosure;

a water outlet path leading out of and in fluid communication with the internal area of the enclosure;

a first connector secured to said housing and in fluid communication with said water outlet path, said first connector adapted for connection to a showerhead sprayer portion;

a second connector in fluid communication with said water inlet path, said second connector adapted for connection to a water source pipe;

a power source to energize said heating element when it is desired to warm water flowing through the enclosure, a flow sensor in communication with said water inlet path, said flow sensor determining when water is entering into the internal area of said enclosure;

wherein said flow sensor is a turbine flow sensor.

14. A combined showerhead and tankless water heater, comprising:

a housing having a front end and a back end;

an enclosure contained within the housing;

a heating element disposed within an internal area of the enclosure;

a water inlet path leading into and in fluid communication with the internal area of the enclosure;

a water outlet path leading out of and in fluid communication with the internal area of the enclosure, a first end of said water outlet path is secured at the top of said enclosure near or adjacent to an outlet end or portion of said enclosure;

a first connector secured to said housing and in fluid communication with said water outlet path, said first connector adapted for connection to a showerhead sprayer portion;

a second connector in fluid communication with said water inlet path, said second connector adapted for connection to a water source pipe;

a power source to energize said heating element when it is desired to warm water flowing through the enclosure; and a diverter pipe secured at a top portion of said enclosure and in fluid communication with said enclosure at a first end and in fluid communication with said water outlet path at a second end, said first end of said diverter pipe is disposed at the top of said enclosure near or adjacent to an inlet end or portion of said enclosure.

15. The combined showerhead and tankless water heater of claim 14 further comprising a turbine flow sensor in communication with said water inlet path, said flow sensor determining when water is entering into the internal area of said enclosure.

16. The combined showerhead and tankless water beater of claim 15 further comprising an onboard circuit board contained within said housing and in communication with said flow sensor, said circuit board including a microprocessor which receives information from said flow sensor and determines how much power to supply to said heating element.

17. The combined showerhead and tankless water heater of claim 16 further comprising a control panel in communication with said onboard circuit board, wherein said control panel allowing a user to increase or decrease the amount of power that is supplied to said heating element, wherein said control panel is located on a bottom portion of said housing.

18. The combined showerhead and tankless water heater of claim 14 wherein said power source is an electric cord which extends out of said housing.

19. The combined showerhead and tankless water heater of claim 14 wherein said first connector is a male adaptor; wherein said second connector is a nut secured to an external end of said water inlet path extending out of said housing and adapted for receipt and securement to an end of the water source pipe.

20. A combined showerhead and tankless water heater, comprising:

a housing having a front end and a back end;

an enclosure contained within the housing;

a heating element disposed within an internal area of the enclosure;

a water inlet path leading into and in fluid communication with the internal area of the enclosure;

a water outlet path leading out of and in fluid communication with the internal area of the enclosure, a first end of said water outlet path is secured at the top of said enclosure near or adjacent to an outlet end or portion of said enclosure;

a threaded male adaptor secured to said housing and in fluid communication with said water outlet path, a showerhead sprayer portion secured to said threaded male adaptor and in communication with said water outlet path;

a nut secured to an external end of said water inlet path extending out of said housing and adapted for receipt and securement to an end of a water source pipe;

a power source to energize said heating element when it is desired to warm water flowing through the enclosure;

a diverter pipe secured at a top portion of said enclosure and in fluid communication with said enclosure at a first end and in fluid communication with said water outlet path at a second end, said first end of said diverter pipe is disposed at the top of said enclosure near or adjacent to an inlet end or portion of said enclosure;

a turbine flow sensor in communication with said water inlet path, said flow sensor determining when water is entering into the internal area of said enclosure;

an onboard circuit board contained within said housing and in communication with said flow sensor, said circuit board including a microprocessor which receives information from said flow sensor and determines how much power to supply to said heating element; and a control panel in communication with said onboard circuit board, wherein said control panel allowing a user to increase or decrease the amount of power that is supplied to said heating element, wherein said control panel is located on a bottom portion of said housing.

21. The combined showerhead and tankless water heater of claim 20 wherein said power source is an electric cord which extends out of said housing.

* * * * *